United States Patent [19]

Leins et al.

[11] Patent Number: 4,464,912

[45] Date of Patent: Aug. 14, 1984

[54] KNITTING MACHINE

[75] Inventors: Eberhard Leins, Filderstadt; Manfred Walter, Aichtal; Willie Gaiser, Gäufelden, all of Fed. Rep. of Germany

[73] Assignee: Sulzer Morat GmbH, Fed. Rep. of Germany

[21] Appl. No.: 419,929

[22] Filed: Sep. 20, 1982

[30] Foreign Application Priority Data

Sep. 26, 1981 [DE] Fed. Rep. of Germany ..... 3138337

[51] Int. Cl.[3] ..... D04B 7/00

[52] U.S. Cl. ..... 66/77; 66/78

[58] Field of Search ..... 66/60 R, 64 R, 77, 78

[56] References Cited

U.S. PATENT DOCUMENTS 3,779,044 12/1973 Schieber et al. ..... 66/78 X 4,103,517 8/1978 Schmid et al. ..... 66/78 X 4,127,012 11/1978 Schmid et al. ..... 66/62 X 4,287,728 9/1981 Schmid et al. ..... 66/62

*Primary Examiner*—Ronald Feldbaum

[57] ABSTRACT

Knitting machine with at least one needle bed in which knitting tools exhibiting feet are mounted for camming up and camming down, with at least one cam transportable past the feet and influencing the latter, which exhibits at least one cam-down part mounted movably but lockably and unlockably and adjustable as to its cam-down depth, and with a switching apparatus arranged outside the needle bed which exhibits means for unlocking, means for adjusting and means for locking the cam-down part, while the means for adjusting the cam-down depth exhibit an adjustable guide rail intended to slide the cam-down part and a switching device to adjust the guide rail according to pattern before the cam-down part rides up (FIGS. 1 and 6).

23 Claims, 10 Drawing Figures

KNITTING MACHINE

The invention relates to a knitting machine of the category defined in the pre-characterising clause of Claim 1.

In knitting machines of this type (e.g. German Offenlegungsschrift Nos. 25 31 705, 25 31 734 and 25 31 762) the slide tracks are generally provided above the feet of the knitting tools and intended to influence cam-down parts arranged resiliently on the cams, in order to slide these parts, during the passage of the cams past the knitting tools, into such a position relatively to the needle bed that the knitting tools are cammed down by the amount prescribed according to pattern for the stitch formation.

Because it may be desirable from considerations of pattern to adjust consecutive cam-down parts to different cam-down depths or sinking depths, it is already known (German Offenlegungsschrift No. 25 31 705) to provide above each needle bed a group of slide tracks adjustable in their height correspondingly to the desired cam-down depth, and on each cam-down part or its support a number of grooves corresponding to the number of the slide tracks, into which grooves slide pieces in the form of plates are insertible in order to associate each cam-down part with a selected slide track. In the case of great working widths of the knitting machine, it is impossible to produce the slide tracks with the requisite precision. Moreover, the slide tracks can be arranged only on the rear side of the needle beds, i.e. beneath the needles, since otherwise they would obstruct the access to the needle beds. One consequence of this is that the cam-down parts must also be transported through the needle bed beneath or behind the needles, so that feet breaking off from the needles frequently remain caught in the cam-down parts, are dragged along by the latter and cause major consequent damage. Lastly, devices of this type are not suitable for an individual adjustment according to pattern of the cam-down depth of the individual cam-down parts whilst the knitting machine is running.

It is in fact already known (German Offenlegungsschrift No. 25 31 705), for the adjustment of the cam-down parts whilst the knitting machine is running, to provide controllable switching apparatuses for the pre-adjustment of each cam-down part outside the needle beds and to lock the cam-down parts clampingly by means of springs after the adjustment and unlock them before the adjustment. However, no practically serviceable and operationally reliable constructive solution for such a switching apparatus has hitherto become known.

It is therefore the underlying aim of the invention to produce a switching apparatus for a knitting machine of the category initially defined, which permits the adjustment of the cam-down depth of each individual cam-down part before its passage past the knitting tools by simple structural means and by means of a simple control process.

The characterising features of Patent Claim 1 are provided in order to achieve this aim.

The invention procures the advantage that the adjustment of the cam-down depth of each cam-down part can occur before its passage past the knitting tools by a simple modulation of the switching device. It is therefore not necessary either to associate active control members with moving parts, such as the cams, or to stop these parts temporarily during the operation of the knitting machine for the purpose of adjusting the cam-down depth. Apart from this, the control device may according to the invention comprise a simple stop mechanism which arranges a slide supporting the guide rail in the position required for the adjustment of the cam-down depth according to pattern before each passage of a cam-down element. Lastly, a particular advantage of the invention lies in the fact that the cam-down parts can be guided along on the front side of the needle beds and in front of the needles without the access to the needles being substantially obstructed. Breaking needle feet therefore fall out to the rear, without causing consequent damage.

Further advantageous features of the invention are characterised in the subordinate claims.

The invention is explained more fully below by exemplary embodiments in conjunction with the accompanying drawing, wherein.

Figure 6:
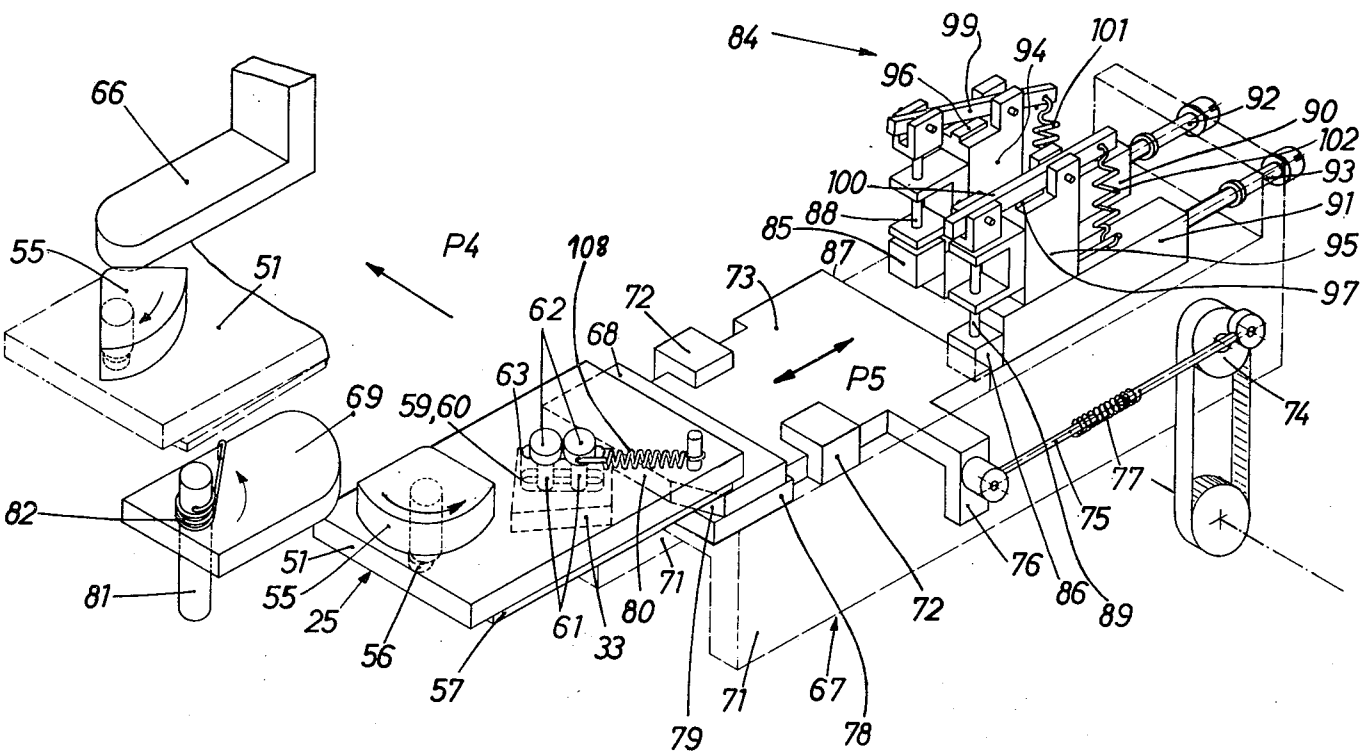
FIG. 6 shows a schematic perspective view of a switching apparatus for adjusting the cam-down depth according to the invention.
Figure 8:
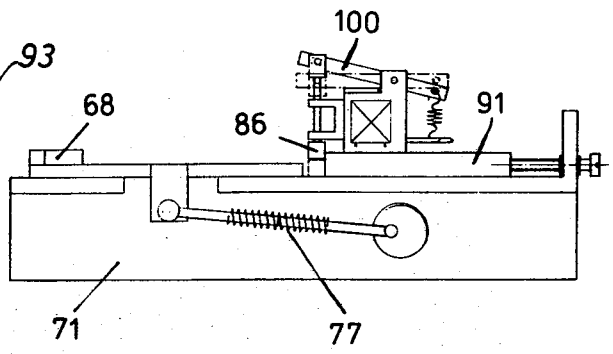
Figure 7:
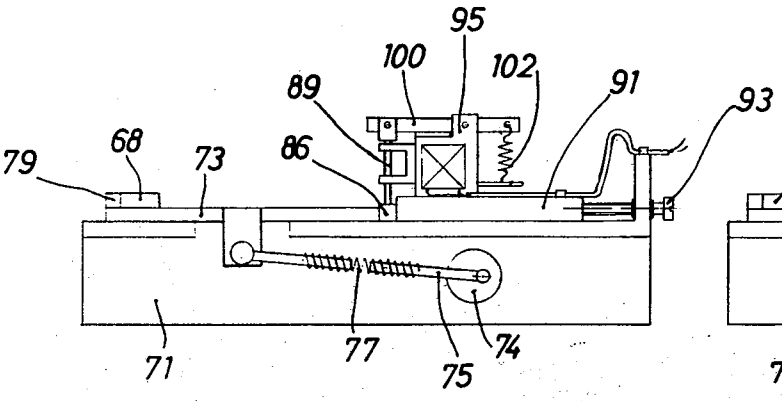
Figure 9:
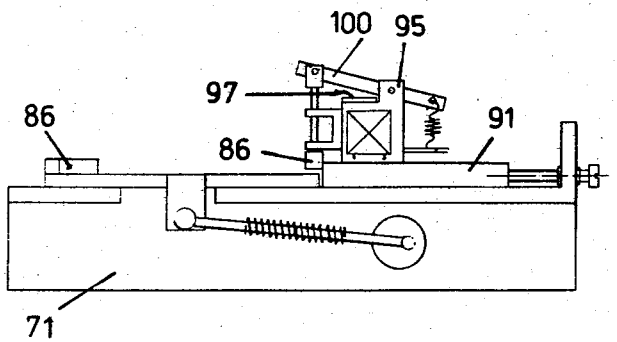
Figure 10:
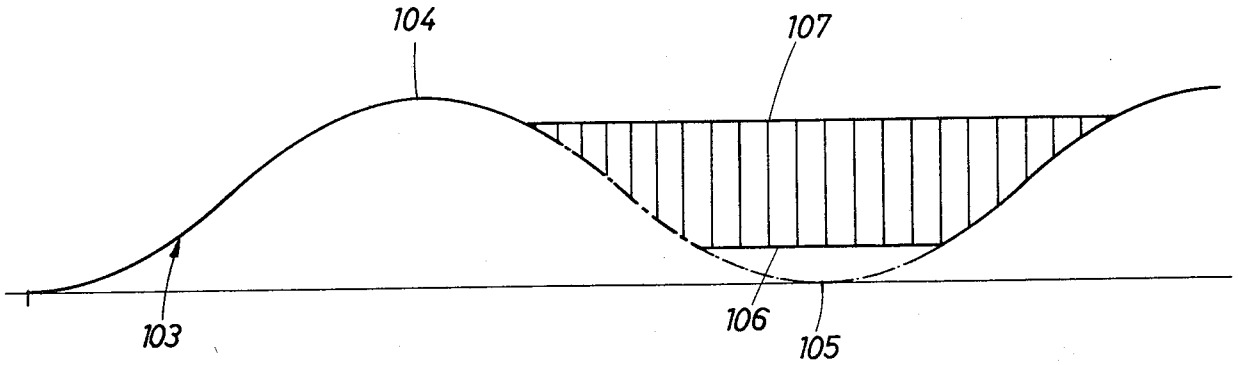

FIGS. 7 to 9 each show a schematic side elevation of the switching apparatus according to FIG. 6, with different phases of the work cycle; and FIG. 10 shows schematically a graph of the stroke of a slide of the switching apparatus according to FIGS. 6 to 9.

Figure 1:
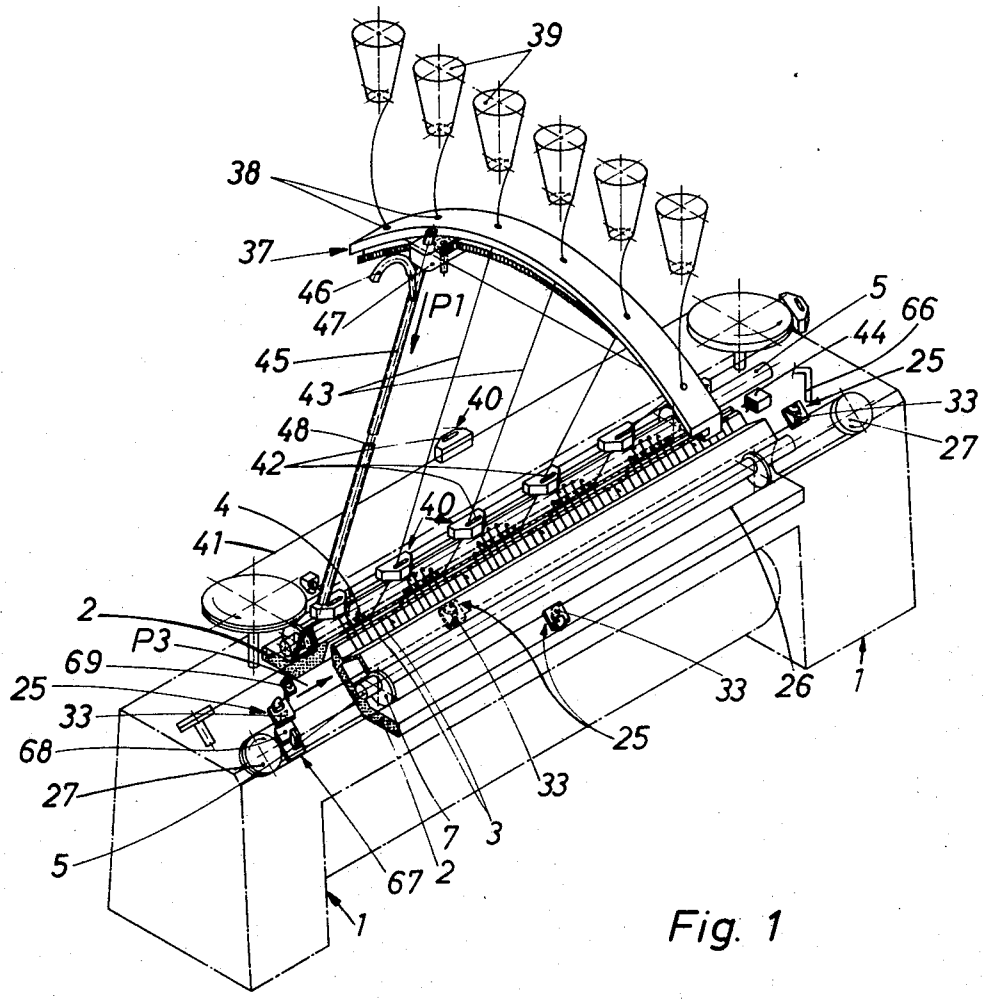
FIG. 1 shows a perspective view of a knitting machine according to the invention.
Figure 2:
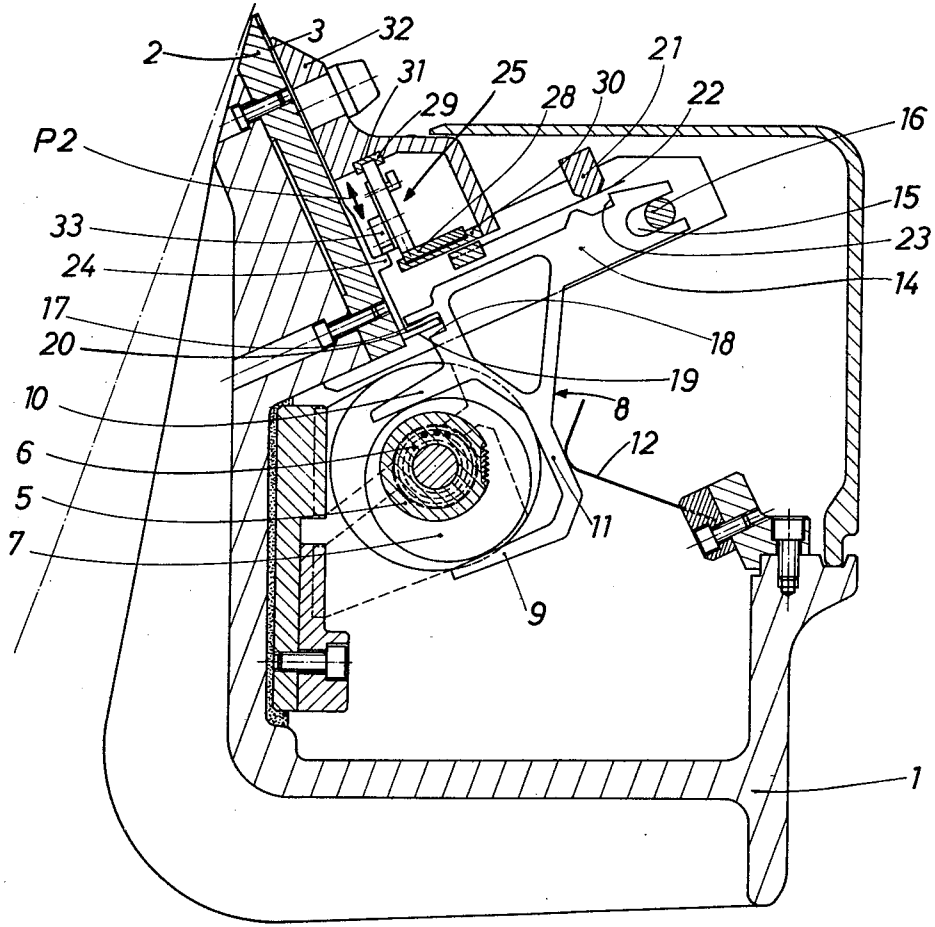
FIG. 2 shows a section through the needle bed of the knitting machine according to FIG. 1.

FIGS. 1 and 2 illustrate a flat knitting machine according to German Offenlegungsschrift No. 25 31 705. In a frame 1, two needle beds 2 are mounted stationary in vee-shaped arrangement, in the grooves of which knitting needles 3 with hooks 4, preferably latch needles, are mounted for longitudinal sliding. A driving shaft 5 constructed as a hollow shaft or solid shaft is mounted rotatably in bearings 6 in each needle bed 2.

A number, corresponding to the number of the knitting needles 3, of eccentric disc cams 7 arranged with mutual angular offset is aligned integrally in rotation on the driving shafts 5. As FIG. 2 shows, a drive element 8, which is constructed as a fork with two arms 9 and 10 which are joined mutually by a connecting bridge 11 acting as a coupling element, is placed on each disc cam 7. The two arms 9,10 embrace the disc cam 7 from two sides so that during the rotation of the driving shafts 5 the drive elements 8 are raised and lowered parallel to the needle axes by the disc cams 7 and thus execute cam-up strokes and cam-down strokes. Each drive element 8 is maintained on the disc cam 7 by a contact spring 12 abutting the bridge 11.

A shaft 14, which is provided on a lateral part of the drive element 8 confronting the connecting bridge 11, is mounted in a sliding and pivot bearing which is formed by a slot 15 in the shaft 14 and an axis 16 fixed in the frame 1 and penetrating the slot 15.

A recess is provided at a top section of the drive element 8, the top edge of which serves as a cam-down member 17, and its bottom edge as a cam-up member 18, for a foot of the knitting needle 3 associated with it, for the bottom edge of which is to be considered correspondingly as cam-up member 19 and its top edge as cam-down member 20. The cam-up member 17 has such a length that it overlaps the cam-down member 20 during the cam-down stroke of the disc cam 7 in every possible position of the drive element 8, whereas the cam-up member 18 is so short that it overlaps the cam-up member 19 only in the coupling position of the coupling element 11 visible in FIG. 2, but lies outside the region of influence of the cam-up member 19 in a decoupling position.

A selector device, which is provided for the selection of each of the knitting needles 3 according to pattern, comprises in the exemplary embodiment illustrated a holding magnet 21 controllable according to pattern and a unilaterally clamped control spring 22 which is applicable by means of a projection provided on the shaft 14 to the pole surface of the holding magnet 21. When the holding magnet 21 attracts the control spring 22, the connecting bridge 11 is applied by the contact spring 12 to the associated disc cam 7, so that the cam-up member 18 overlaps the cam-up member 19. On the other hand, when the control spring 22 is not attracted by the holding magnet 21, it drops away from its pole surface due to its pretension and abuts a stop 23 constructed on the shaft 14, so that the drive element is locked in a retracted position in spite of the action of the contact spring 12, and the cam-up member 18 stands still outside the region of engagement of the cam-up member 19.

Each knitting needle 3 also exhibits a foot 24, which can cooperate with a plurality of cams 25. The cams 25 are each mounted on support elements 28, which are attached to endless bands or chains 26 which are mounted on return pulleys 27 and are driven by means of a drive device, not shown. During their passage past the two nedle rows the support elements 28 are guided and braced in grooves of slide rails 30 which are attached to covers 32 of the needle beds 2, whilst the top edges of the cams 25 slide simultaneously in grooves of slide rails 29 which are fixed in grooves 31 of the covers 32 and are, like the slide rails 30, arranged parallel to the needle beds 2 and extend stationary across the entire width of the needle beds. The cams 25 are thereby arranged in the same invariable height during their passage past the knitting needles 3. The slide rails 29 may consist of individual segments abutting mutually in the longitudinal direction of the needle beds.

Each cam 25 comprises a cam-down part 33 effective in the cam-down direction, and in case of need a cam-up part, not shown, rising in the cam-up direction, whilst the feet 24 of the knitting needles 3 are at first cammed down by the cam-down part 33 in order to form a stitch and then restored into the normal pass-through position by the cam-up part. According to the invention the feet 24 then project outwards and upwards. Consequently the cams 25 and cam-down parts 33 are transported past the feet 24 above and outside, so that they can be disassembled without demounting the needles 3 after the cover 32 has been removed.

In the specific type of knitting machine according to FIGS. 1 and 2, the cams 25 are arranged at such a height relatively to the feet 24 that the feet can ride up onto the cam-down parts 33 only after the knitting needles 3 have been cammed down virtually into the normal pass-through position by means of the cam-down members 17 of the drive elements 8. The cam-down parts 33 therefore become operative only at the end of a complete cam-down stroke of the disc cams 7 and cause only that small part of the cam down which serves to form a stitch or to draw a yarn loop formed by a hook 4 through the previously formed stitch resting on the needle shank, whereas the major part of the cam-down is performed by means of the drive element 8 driven positively by the disc cam 7. In order to prevent the additional cam-down stroke caused by the cam-down part 33 from disturbing the cam-down stroke caused by the drive element 8, the arrangement is made so that the interval between the cam-down members 17 and the cam-up member 18 of the drive elements 8 is greater than the interval between the cam-up member 19 and the cam-down member 20 of the knitting needle 3 by approximately as much as corresponds maximally to the additional cam-down stroke obtainable by the cam-down cam 33, i.e. the propulsive connection of the knitting needle 3 to the disc cam 7 exhibits sufficient play for the knitting needle 3 to be movable in the direction of its movement additionally by a sufficient amount to the movement caused by the disc cam 7.

In order to feed the yarns, e.g. the device illustrated in FIG. 1 (cp. German Offenlegungsschrift No. 25 31 734) may be used, which exhibits a support 37 for yarn eyes 38 arranged above the machine frame, above which yarn spools 29 are arranged. A plurality of yarn guides 40, which are provided in the region of the hooks 4 of the knitting needles 3, are guided past the knitting needles along a line parallel to the needle beds 2 by means of endless bands 41 mounted on return pulleys. Each yarn guide 40 exhibits an eye 42, into which a yarn 43 coming from any yarn spool 39 can be inserted. A cutting device 44 for the yarns 43, which is located at the right-hand end in FIG. 1 of the needle beds 2, becomes operative after the passage of any yarn guide 40 to the needle beds 2.

In order to return the yarn end which is released by the cutting of any yarn 43 to the left-hand end in FIG. 1 of the needle beds 2, and in order to prevent stranding of the yarns, a blowpipe 45 is provided, through which pressurised air is forced in the direction of an arrow P1 by a hose 46 connected to a pressurised air source. The top end of the blowpipe 45 is arranged, by means of a pivot mechanism 47, close beneath the yarn eye 38 associated with the free yarn end, and is constructed so that in conjunction with the pressurised air supplied it executes a combined suction and blast effect. This causes the associated yarn end to be sucked in through the top end of the blowpipe 45 and forced down within the blowpipe 45 towards the bottom end of the blowpipe. The bottom end of the blowpipe 45 is arranged just above that position where the eyes 42 travel past, so that a yarn forced through the blowpipe 45 can be blown in each case through the eye 42 of an associated yarn guide 40. The blowpipe 45 also exhibits a lateral slit 48, which on the one hand ensures correct transport of the yarn in the blowpipe, but on the other hand permits the lateral withdrawal of a yarn present in the blowpipe after it has been inserted into an eye 42.

Further particulars and the principle of operation of the knitting machine described are known (e.g. German Offenlegungsschrift No. 25 31 705), so that further explanations may be omitted.

Figure 5:
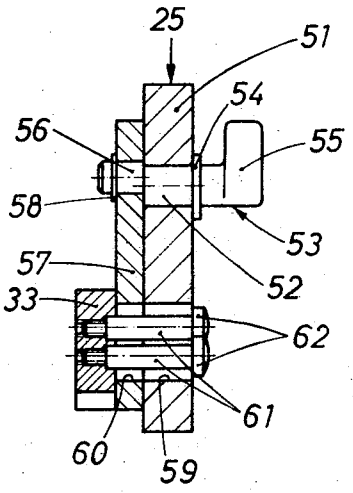
FIG. 5 shows a section through the cam according to FIG. 3 along the line V—V.

The cam-down part 33 is mounted on the cam 25 slidably in the direction of an arrow P2 (FIG. 2) for the purpose of varying the cam-down depth. According to FIGS. 3 to 6 the cam 25 exhibits a support 51 constructed as a support plate etc., which contains a bore in which a bolt 52 of an actuating member 53 is mounted rotatably, and which rides up with its top boundary surface in FIG. 5 onto the slide rails 29 (FIG. 2). The support element 28 is omitted from this illustration. The bolt is provided at its one end, which projects out of the support 51, with a collar 54 and with a control lever 55, but at its other end, which projects out of the support 51, with an eccentric 56 in the form of an eccentrically arranged projection. The eccentric 56 projects into a bore of a clamping plate 57 arranged parallel to the support 51 and is provided at its end projecting out of the latter with a circlip 58 etc., by which the clamping plate 57 is retained captively but pivotably on the support 51.

Figure 3:
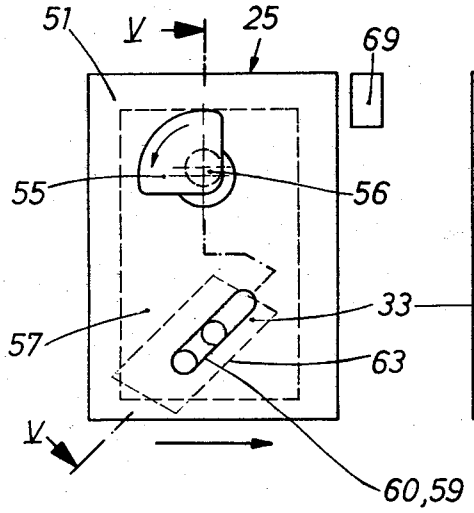

The support 51 and the clamping plate 57 are also provided each with a slot 59 or 60 of substantially equal width, which are mutually aligned in the unlocking position visible from FIG. 3. The slots 59,60 are penetrated by two bolts 61 which each carry, on their ends projecting out of the support on the side of the control lever 55, a head 62, the width of which is greater than the width of the slots 59,60. The ends of the bolts 51 which project out of the slots 59,60 on the side of the clamping plate 57 are provided with a screwthread and screwed into the cam-down part 33 arranged on the free surface of the clamping plate 57. The cam-down part 33 can consequently be slide in reciprocation in the longitudinal direction of the slots 59,60 relatively to the support 51 and to the clamping plate 57, whereby its preferably rectilinear cam-down cam 63 which influences the feet 24 of the knitting tools 3 (FIG. 2), and hence the cam-down depth determined by it, can be varied. Two possible positions of the cam-down part 33 are indicated in FIGS. 3 and 4, the heads 62 of the bolts being omitted.

Figure 4:
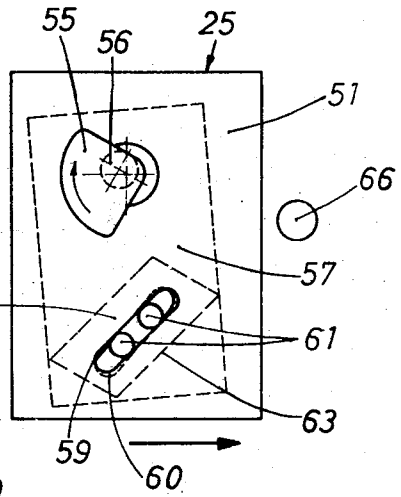
FIGS. 3 and 4 show schematic plans of a cam according to the invention in an unlocked and in a locked position, without the elements required for transport and for guidance.

The required position of the cam-down part 33 relatively to the support 51 and to the clamping plate 57 can be locked by pivoting the control lever 55 out of a position shown in FIG. 3 into the position shown in FIG. 4. This pivoting movement causes the eccentric 56, and with it the clamping plate 57, to be pivoted relatively to the support 51 on the one hand, and the two slots 59,60 to be brought into a slightly mutually twisted relative position on the other hand. This causes the one edge of the slot 60 in each case to press one of the two bolts 61 against the opposite edge of the slot 59, whereby the bolts 61 are locked by jamming in the two slots 59,60. A pivoting back of the control lever 55 has the result that the two slots 59, 60 become mutually aligned again (FIG. 3) and the cam-down part 33 is unlocked by releasing the bolts 61.

The relative displacement of the two slots 59, 60 is shown exaggeratedly large in FIG. 4. For an equal size of the two slots and bolts 61 dimensioned correspondingly to the slot width, an extremely small displacement is sufficient in practice to overcome the small gap which customarily exists between the bolts 61 and the edges of the slots 59,60 and to clamp the bolts 61 immovably. It would be possible to provide, instead of the two bolts 61, a groove block which is of kidney-shaped construction and results, e.g., if the two bolts 61 are produced of one piece and the interstice between them is filled. It would also be possible to arrange the support 51 between the clamping plate 57 and the cam-down part 33.

The length of the pivoting stroke of the control lever 55 which is necessary for the secure locking and unlocking of the cam-down part 33 can be adapted to the conditions desired in the individual case by suitable construction of the eccentric 56.

According to FIG. 1 the cams 25 are transported past the feet of the knitting tools 3 in the direction of an arrow P3. In dorder that the cam-down depth of each individual cam-down part 33 can be adjusted individually, a switching apparatus which is associated with each needle bed 2 exhibits means for unlocking, means for adjusting and means for locking the cam-down part 33, whilst these means are or may be arranged at different points along the transport path of the cam-down parts 33.

The unlocking means consist e.g. of a set element 66 which is arranged at the end of the needle bed 2 in the transport direction P3 and influences the control lever 55 in the manner visible in FIGS. 1,4 so that the clamping plate 57 is pivoted in the unlocking direction and the cam-down part 33 is thereby released.

The adjusting means comprise e.g. a guide rail 68 which is adjustable by means of a switching device 67 and which may be arranged immediately in front, in the transport direction P3, of the start of the needle bed and pushes the released cam-down part 33 into the required position. The displacement of the cam-down part preferably occurs parallel to the cam-down cam 63, so that the needle cams on both needle beds 2 can always be constructed equal, but mutually staggered by half a needle pitch, independently of the adjusted cam-down depth, until the laying-in of the yarn and closing of the latches is complete.

Lastly, the locking means consist e.g. of a set element 69 which is arranged in front, in the transport direction P3, of the end of the guide rail 68 and influences the control lever 55 in the manner visible from FIGS. 1,3 so that the clamping plate 57 is pivoted in the locking direction and the cam-down part 33 is thereby firmly clamped.

The switching device 67 and the guide rails 68 are illustrated in FIGS. 6 to 9 schematically and from a different viewing angle compared to FIG. 1, in order to simplify the illustration. The direction of movement of the cams 25 is indicated by an arrow P4. The support element 28 is omitted for the sake of simplicity.

The switching device comprises a bracket 71 upon which a slide 73 is mounted by guide means 72, being capable of reciprocating movement in the direction of an arrow P5 by means of a crank transmission. The crank transmission comprises a crank 74 and a connecting rod 75 articulated to the latter, the other end of which is articulated to a lateral lug 76 of the slide 73. The connecting rod 75 consists of two parts which are mutually coupled by a spring 77, which is guided in a sleeve not shown.

The guide rail 68 is fixed on the top side of the front end 78 of the slide and is provided on its front side, in the transport direction of the cam 25, with a guide surface 79 arranged obliquely to the transport direction for the cam-down part 33, which is adjoined by a rectilinear stabilising surface 80 arranged parallel to the transport direction of the cam. By means of the belts or chains 26 visible in FIG. 1, the cam 25 is moved past the guide rail 68 so that the support 51 and the clamping plate 57 slide along directly above the guide rail 68 and the cam-down part 33, which is arranged beneath the clamping plate 57 in FIG. 6 and therefore shown by dash lines, rides up with its bottom edge at first onto the guide surface 79 and then onto the stabilising surface 80. Because the cam-down part 33 is in its unlocked state, which was created at a point located in front of the guide surface 79 by the set element 66 arranged top left in FIG. 6, the cam-down part 33 follows the track of the guide surface 79, by the bolts 61 sliding in the slots 59,60, and assumes the required position on reaching the stabilising surface 80.

The stabilising surface 80 serves to stabilise this position. The set element 69 is arranged in front of the end of the stabilising surface 80 so that the stoppage of the cam-down part 33 on the support 51 occurs before the sliding off the stabilising surface 80.

The set element 69 is conveniently mounted rotatably on a journal 81 and pretensioned into the position visible from FIG. 6 by means of a spring 82 braced between the journal and the set element 69. It is thereby achieved that only a torque determined by the spring 82 can be exerted upon the control lever 55 and the set element 69 is pivoted away laterally when the clamping position is reached. Any excessive tensioning of the bolts 61 and of the clamping plate 57, leading to damage, is thereby effectively prevented.

Guide means, not shown, may be provided in case of need to fix the position of the cam 25 whilst passing the guide rail 68.

In order to vary the position of the guide rail 68, and hence also to vary the adjusted cam-down depth, the switching device 67 comprises a controllable stop mechanism 84. This is associated with the one dead centre position, rear in FIG. 6, of the slide 73 and limits the stroke of the slide 73 during its movement from left to right. The drive of the slide effected by the crank transmission does not counteract such a stroke limitation, because the spring 77 can expand in this direction.

The stop mechanism 84 comprises a plurality of e.g. parallelepipedic or otherwise contructed stops 85 and 86, which cooperate with an associated slide part, e.g. with the rear slide end 87, and can be set selectively into the path of the slide 73. The stops 85 and 86 are arranged staggered in the direction of the arrow P5, so that the backward path of the slide 73 is shorter when the stop 86 is selected than when the stop 85 is selected.

Each stop 85,86 is fixed to a support element 88 or 89 mounted movably at right angles to the direction of movement of the slide 73, and each support element is associated with a control member, by means of which a selected stop 85,86 can be pushed into the path of the slide 73. Also, according to FIG. 6, each stop 85,86 is mounted on a respective unit displaceable in the direction of the arrow P5, which comprises a stop rail 90,91 which can be moved in reciprocation by means of a set screw 92,93 mounted in the bracket 71.

A control member in the form of a control magnet 94,95 with a control pole 96,97 is mounted on each stop rail 90,91. A pivot lever 99 or 100 mounted pivotably on the associated control magnet 94,95 which extends across the control pole has its one end engaged by an end of a traction spring 101,102, and its other end articulated to the support element 88,89. The other ends of the traction springs 101,102 are fixed to the stop rail 90, 91 and to the control magnet 94,95 respectively, so that the stops 85,86 are pretensioned into their top position, in which they are not located in the region of influence of the slide 73 (FIG. 9). By feeding an electrical signal to one of the control magnets 94,95 the associated pivot lever 99,100 is attracted to the corresponding pole surface 96,97 and the associated stop 85,86 is thereby brought into the region of influence of the slide 73 (FIG. 7).

As FIGS. 6 to 9 show, the stops 85,86 are preferably constructed as interposed elements between the slide end 87 and the front stop surfaces of the stop rails 90,91 and abut the associated stop rail in their bottom position in FIG. 6. It is thereby achieved that it is the solid stop rails 90,91 anchored by means of the set screws, and not the comparatively light, controllable stops 85,86 mounted for easy running, which have to absorb the counterforces resulting from the stroke movement of the slide 73. The arrangement is preferably made so that each stop 85,86 exhibits a length in the direction of the arrow P5 which is greater than the maximum adjustment range of the cam-down depth, and that the stop rails 90,91 can be displaced only along a length corresponding to the adjustment range of the cam-down depth. The possibility that the stroke of the slide 73 could be limited by a stop rail 90,91 pushed far forwards instead of by the selected stop 85,86 of a further retracted stop rail, is thereby prevented.

The principle of operation of the described switching device 67 is as follows:

Before a cam-down part 33 rides up onto the guide rail 68, and electrical signal is fed, e.g. to the control magnet 94. This causes its pole surface 96 to attract the pivot lever 99, and consequently the stop 85 is set into the movement path of the slide 73, so that the slide end 87 abuts against the stop 85 during the backward stroke. At this time the spring 77 of the crank transmission commences to expand (FIG. 7). The cam-down part 33 now rides up onto the guide surface 79 and is pushed by the latter into the required position, which is prescribed by the position of the stop 85 and the adjustment of the associated adjusting screw 92. After the stabilising surface 80 is reached, the cam-down part 33 then passes into the region of the set element 69, which locks the required position of the cam-down part 33 and its required cam-down depth.

Meanwhile the crank transmission has commenced its forward stroke, during which the spring 77 becomes relaxed, whereupon the forward stroke of the slide 73 can also commence. These processes are coordinated chronologically so that the cam-down part 33 has with certainty slid off the stabilising surface 80 before the slide is advanced further. When the slide 73 has been advanced so far that it has left the region of influence of the farthest forward positioned stop 85,86 (FIG. 8), a fresh selection process can be initiated and the control signal of the control magnet 94 may be replaced, e.g., by a control signal fed to the control magnet 95, whereby the stop 86 is controlled into the path of the slide 73. Then, during the next backward stroke of the crank transmission, when the slide end 87 abuts the stop 86, the next cam-down part 33 can ride up onto the guide surface 79.

FIG. 10 shows the theoretical movement path 103 of the slide end 87 with the front dead centre position 104 and with the rear dead centre position 105, which could only be reached if the stroke of the slide 73 were not limited by a stop 85,86 (FIG. 9). The arrangement of a stop 85,86 in the rear dead centre position 105 or in close proximity thereto is however impossible for chronological reasons, because the slide 73 is required to remain in an invariable rear limit position for as long as the cam-down part 33 requires to travel through the guide surface 79 and the stabilising surface 80. A line 106 in FIG. 10 therefore indicates the extreme possible rear position of a stop 85,86, and the length of the line 106 corresponds to the dwell time in the rest position necessary for the adjustment and locking of the cam-down part 33. Correspondingly, a line 107 indicates the extreme possible forward position of a stop 85,86. Any still further displacement of the stops 85,86 forwards is impossible, because otherwise the slide end 87 could not be maintained out of the region of influence of the stops for the time necessary for changing the latter. The hatched area in FIG. 10 therefore indicates the actual possible adjustment range for the stops 85,86 and stop rails 90,91.

A particular advantage of the switching device described lies in the fact that the control magnets can be switched overlapped and the time intervals necessary for attracting the pivot levers 99,100 can therefore be commenced before the slide end 87 has left the region of influence of the stops 85,86. The attainable switching speeds are therefore extremely high. A further advantage is seen in the fact that the stop rails 90,91 can be displaced even during running operation by means of the adjusting screws 92,93, which are preferably constructed as micrometer spindles. This permits a fine adjustment of the required cam-down depths by current observation of the quality of the produced knitted fabric during the adjustment of the knitting machine.

The invention is not restricted to the knitting machine described, but may also be applied, e.g., in conventional flat knitting machines, in knitting machines with carriages circulating along an endless track or in circular knitting machines with revolving cams, whilst the cam-down parts may cause the total cam-down of the knitting needles, otherwise than in the knitting machine described.

The invention is also not restricted to the exemplary embodiment described. It is possible e.g. to mount the cam-down part 33 on the support 51 by means of a spring 108 (FIG. 6) so that it is brought into a preferred initial position by this spring as soon as its locking is released. By this means it can be ensured that the cam-down part 33 always assumes the position which corresponds to the greatest cam-down depth in FIG. 6 before riding up onto the guide surface 79. It is further possible to construct the switching device so that the slide is influenced by a stop mechanism, not in the bottom dead centre position according to FIG. 6, but in the opposite dead centre position. In this case the spring 77 would be stressed in compression instead of in tension.

The switching device 67 and the set elements 66,69 need not be arranged in the places visible in FIG. 1, provided it is ensured that the cam-down part has already been adjusted to the required cam-down depth before it rides up onto the foot of the first knitting needle of the needle bed. Lastly, in case of need the guide rail 68 could be so arranged, and the cam-down part 33 so mounted on the support 51, that the cam-down part is displaced in a direction parallel to the direction of movement of the knitting needles 3 when the position of the sinking point is required to be independent of the adjusted cam-down depth.

We claim:

1. Knitting machine comprising: at least one needle bed; knitting tools having butts and mounted in said needle bed to be raised and drawn-down; at least one cam element (25) movable past said butts and having a support (51), a clamping element (57) and at least one draw-down cam part (33) for influencing said butts and thereby at least partially draw-down said knitting tools, said drawing-down cam part being movably mounted on said cam element for adjusting the depth up to which the knitting tools are drawn-down, said support and said clamping element having mutually aligned slots (59,60) which are surrounded by edges, said draw-down cam part being fastened to a fastening means (61) which projects through said slots, and said support and said clamping element being arranged such that by relative movement of said clamping elements and said support said fastening means is optionally clamped between said edges of said slots and thus locked or movable in said slots and thus unlocked; and a switching apparatus to be passed by said cam element, said switching apparatus having means for locking and unlocking said fastening means and means for adjusting said draw-down cam part when said fastening means is unlocked by causing movement thereof in said slots.

2. Knitting machine according to claim 1, wherein said fastening means has two bolts supporting said draw-down cam part.

3. Knitting machine according to claim 1, wherein said cam element has an actuating member (53) for relative movement of said support and said clamping element.

4. Knitting machine according to claim 3, wherein said actuating member has a bolt (52) projecting through said support, said bolt having an eccentric (56) cooperating with said clamping element for moving same in opposite directions.

5. Knitting machine according to claim 4, wherein said means for locking and unlocking said fastening means have a set element (69) for locking said fastening means and set element (66) for unlocking said fastening means, said bolt having a control lever (55) and said set elements being arranged such that they cooperate with said control lever during movement of said cam element past said set elements.

6. Knitting machine according to claim 1, wherein said means for adjusting said draw-down cam part have an adjustable guide rail (68) for moving said draw-down cam part and a switching device (67) for adjusting said guide rail according to a pattern before said draw-down cam part passes said guide rail.

7. Knitting machine according to claim 6, wherein said guide rail (68) has a guide surface (79) arranged obliquely to said draw-down cam part (33) and a stabilizing surface (80) adjoining the latter.

8. Knitting machine according to claim 7, wherein said switching device (67) has a slide reciprocatable between two dead center positions and supporting said guide rail (68), and wherein a controllable stop mechanism (84) is associated with one of said dead center positions of said slide (73) for limiting the stroke of said slide (73) towards this dead center position.

9. Knitting machine according to claim 8, wherein said stop mechanism (84) has a plurality of stops (85,86) for said slide, each stop causing a different selected stroke limitation.

10. Knitting machine according to claim 9, wherein each stop (85,86) is attached to a respective support element (88,89) which is movable perpendicularly to the direction of movement of the slide (73), and wherein with each support element (88,89) a respective control member (94,95) is associated for moving a selected one of said stop elements into a stroke limiting position.

11. Knitting machine according to claim 9 or 10, wherein each stop (85,86) is mounted on a unit (90,91) which is slidable in the direction of movement of the slide (73), and wherein a set member (92,93) is associated with each unit to adjust the position thereof.

12. Knitting machine according to claim 9, wherein each stop (85,86) is constructed as an element interposably mounted between said slide and the respective unit.

13. Knitting machine according to claim 9, wherein each stop (85,86) consists of a parallelepipedic body.

14. Knitting machine according to claim 9, wherein said draw-down cam part has an adjustment range, all the stops (85,86) having the same length which is selected with correspondence to said adjustment range.

15. Knitting machine according to claim 10, wherein said control member (94,95) is a control magnet.

16. Knitting machine according to claim 10, wherein said support elements (88,89) are maintained in a non stroke limiting position by springs (101,102) and can be brought into said stroke limiting position by controlling the associated control member (94,95).

17. Knitting machine according to claim 8, wherein said slide (73) is connected to a crank transmission having a crank and a connecting rod (75) which consists of two parts connected by a spring (77).

18. Knitting machine according to claim 7, wherein the means for locking said fastening means is arranged between the beginning and the end of said stabilizing surface (80).

19. Knitting machine according to claim 1, wherein said knitting tools (3) are provided with butts (24) pointing towards the front side of said needle bed (2), said draw-down cam part (33) being arranged on the rear side of the cam (25).

20. Knitting machine according to claim 1 comprising: eccentric disc cams (7) propulsively connectable to said knitting tools (3) and arranged with angular offset on a rotatable drive shaft (5) for raising and drawing down said knitting tools (3), said drive shaft being rotatable with a rotary speed, while in order to adjust the magnitude of the strokes of said knitting tools in the draw-down direction the propulsive connections of the knitting tools (3) with the disc cams (7) exhibit play; and a plurality of said cam elements (25) for drawing down said knitting tools (3) by preselectable parts of the distance corresponding to said play additionally to a draw-down caused by said disc cams (7); wherein said cam elements (25) are arranged on a transport device arranged on the needle bed (2) and being transported with a linear speed so that the draw-down cam parts (33) commence at a height which corresponds to the position of the butts (24) of the knitting tools (3) just before the completion of said draw-down caused by said disc cams (7), said linear speed of said transport device and said rotary speed of said driving shaft (5) being synchronized so that the transport of the cam elements (25) past said butts is adapted to the phase positions of said knitting tools (3) dictated by the angular offset of said disc cams (7).

21. Knitting machine according to claim 1, wherein said draw-down cam part (33) has a draw-down curve (63), the movement of said draw-down cam part (33) being substantially parallel to said curve (63).

22. Knitting machine, comprising: at least one needle bed; knitting tools having butts and being mounted in said needle bed to be raised and drawn-down; at least one cam element movable past said butts and having at least one draw-down cam part for influencing said butts and thereby at least partially draw-down said knitting tools, said draw-down cam part being movably mounted on said cam element for adjusting the depth up to which the knitting tools are drawn-down; clamping means on said cam element for locking and unlocking said draw-down cam part by clamping and unclamping; and a switching apparatus to be passed by said cam element, which switching apparatus has means acting on said clamping means for locking and unlocking said draw-down cam part and adjusting means for adjusting said draw-down cam part when it is unlocked, said adjusting means having an adjustable guide rail (68) for acting on said draw-down cam part, which guide rail has a slide which is reciprocatably mounted in opposite directions between two dead center positions, and a switching device for adjusting said guide rail according to a pattern before said draw-down cam part passes said guide rail, said switching device comprising a crank transmission having a crank and a connecting rod (75) coupled to said slide and to said crank and consisting of two parts connected by a spring (77), and a plurality of stops, each stop causing a different selected stroke limitation of said guide rail in one of said directions and thereby relative motion of said two parts of said connecting rod.

23. Knitting machine according to claim 22, wherein each stop element is mounted on a unit (90,91) adjustably mounted in the direction of movement of the slide, each stop element being constructed as an element interposably mounted between said slide and the respective unit.

* * * * *